US007223017B2

(12) United States Patent
Weaver

(10) Patent No.: US 7,223,017 B2
(45) Date of Patent: May 29, 2007

(54) SIDE GUSSET BAG WITH RECLOSE FEATURE

(75) Inventor: Rodney M. Weaver, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 509 days.

(21) Appl. No.: 10/741,125

(22) Filed: Dec. 19, 2003

(65) Prior Publication Data

US 2005/0137073 A1 Jun. 23, 2005

(51) Int. Cl.
*B65D 33/16* (2006.01)
*B65D 30/20* (2006.01)

(52) U.S. Cl. ..... 383/63; 383/65; 383/120

(58) Field of Classification Search ..... 383/63, 383/120, 65

See application file for complete search history.

(56) References Cited

U.S. PATENT DOCUMENTS

| | | | | |
|---|---|---|---|---|
| 3,283,672 | A | 11/1966 | Mueller | |
| 3,473,589 | A | 10/1969 | Gotz | |
| 4,260,116 | A | 4/1981 | Collin | |
| 4,355,494 | A | 10/1982 | Tilman | |
| 4,392,897 | A | 7/1983 | Herrington | |
| 4,419,159 | A | 12/1983 | Herrington | |
| 4,561,109 | A | 12/1985 | Herrington | |
| 4,618,383 | A | 10/1986 | Herrington | |
| 4,620,320 | A | 10/1986 | Sullivan | |
| 4,673,383 | A | 6/1987 | Bentsen | |
| 4,698,954 | A | 10/1987 | Behr et al. | |
| 4,736,450 | A | 4/1988 | Van Erden et al. | |
| 4,741,789 | A | 5/1988 | Zieke et al. | |
| 4,764,977 | A | 8/1988 | Wagers | |
| 4,840,611 | A | 6/1989 | Van Erden et al. | |
| 4,878,987 | A | 11/1989 | Ven Erden | |
| 4,892,512 | A | 1/1990 | Branson | |
| 4,945,714 | A | 8/1990 | Bodolay et al. | |
| 4,954,124 | A | 9/1990 | Erickson et al. | |
| 5,047,002 | A | 9/1991 | Zieke et al. | |
| 5,049,223 | A | 9/1991 | Dais et al. | |
| 5,275,491 | A * | 1/1994 | Kuge et al. | 383/61.2 |
| 5,364,189 | A * | 11/1994 | Kuge et al. | 383/61.2 |
| RE34,905 | E | 4/1995 | Ausnit | |
| 5,417,035 | A | 5/1995 | English | |

(Continued)

FOREIGN PATENT DOCUMENTS

| | | |
|---|---|---|
| EP | 0 834 454 | 6/1997 |

(Continued)

*Primary Examiner*—Jes F. Pascua
(74) *Attorney, Agent, or Firm*—DLA Piper US LLP

(57) ABSTRACT

A bag constructed of a mono-web material is provided. The bag includes a first panel, a second panel, a reclose feature and at least one gusset. The first panel has an inner side and an upper edge. The second panel also has an inner side and an upper edge. The gusset has an inside edge disposed between the inner side of the first panel and the inner side of the second panel. The reclose feature has two halves of complementary shape and a flange. The first half of the reclose feature is attached to the upper edge of the inner side of the first panel. The second half of the reclose feature is attached to the upper edge of the inner side of the second panel. The flange covers a portion of the inside edge of the gusset.

10 Claims, 4 Drawing Sheets

U.S. PATENT DOCUMENTS 5,542,902 A 8/1996 Richison et al.
5,908,245 A * 6/1999 Bost et al. ..... 383/9
5,938,337 A 8/1999 Provan et al.
6,017,412 A 1/2000 Van Erden et al.
6,030,123 A * 2/2000 Mitarai ..... 383/63
6,068,585 A 5/2000 Ouchi
6,080,252 A 6/2000 Plourde
6,212,857 B1 4/2001 Van Erden
6,327,837 B1 12/2001 Van Erden
6,393,804 B1 * 5/2002 Ausnit ..... 53/412
6,461,043 B1 10/2002 Healy et al.
7,014,363 B2 * 3/2006 Hanson ..... 383/120

FOREIGN PATENT DOCUMENTS

JP 9-278044 10/1997
JP 2002-179086 6/2002
JP 2002-211592 7/2002

* cited by examiner

SIDE GUSSET BAG WITH RECLOSE FEATURE

FIELD OF THE INVENTION

The invention relates to the field of packaging, and particularly to side gusset pouches and bags with reclosure features.

BACKGROUND OF THE INVENTION

Pre-made side gusset pouches and bags are commonly used for a variety of products. The bags are often produced by forming a single or mono-web material into a tube. As the tube travels along the bed of the bag machine, the side-gussets are created by plowing a portion of the web into the tube. If a reclose feature is desired on a mono-web bag, it is typically added post production of the bag. This process can be time consuming and costly. Additionally, traditional side-gusset mono-web bags do not incorporate an easy-open feature because of the presence of the side-gussets.

SUMMARY OF THE INVENTION

In one aspect, the invention is directed to a bag (which is also referred to as a pouch throughout the specification) that includes a first panel, a second panel, at least one gusset and a reclose feature. The first panel has an inner side and an upper edge. The second panel has an inner side and an upper edge. The gusset has an inside edge disposed between the inner side of the first panel and the inner side of the second panel. The reclose feature has two halves of complementary shape and a flange. A first half of the reclose feature is attached to the upper edge of the inner side of the first panel. The second half of the reclose feature is attached to the upper edge of the inner side of the second panel. The flange covers a portion of the inside edge of the gusset.

The bag can also include a tab portion integral to the upper edge of the first panel and to the upper edge of the second panel. A seal can be located proximate to the reclose feature. The seal can extend from the upper edge of the first panel and the upper edge of the second panel to a point substantially equal to a bottom edge of the flange. The reclose feature can be a zipper type feature.

In another aspect, the invention is directed to a bag constructed of a mono-web material. The bag has at least one gusset and a reclose feature. The gusset has a pair of faces disposed within the bag. The reclose feature has a flange that covers at least a portion of the pair of faces of the gusset.

The invention also relates to a method of manufacturing a bag. The method includes the steps of attaching a first half of a reclose feature having a flange to a mono-web film having a left edge and a right edge, removing a portion of the mono-web film adjacent to the reclose feature, and sealing the left edge and the right edge of the mono-web film to each other to create a tube. The method also includes the step of adding at least one gusset to the mono-web tube. The gusset has an inside edge disposed within the tube. After forming the gusset, a second half of the reclose feature is attached to a portion of the tube opposite the first half of the reclose feature. The flange of the reclose feature covers a portion of the inside edge of the gusset and attaches the portion of the inside edge of the gusset to the inner side of the tube.

BRIEF DESCRIPTION OF THE DRAWINGS

For the purpose of illustrating the invention, there is shown in the drawings a form which is presently preferred; it being understood, that this invention is not limited to the precise arrangements and instrumentalities shown.

DETAILED DESCRIPTION OF THE DRAWINGS

Figure 1:
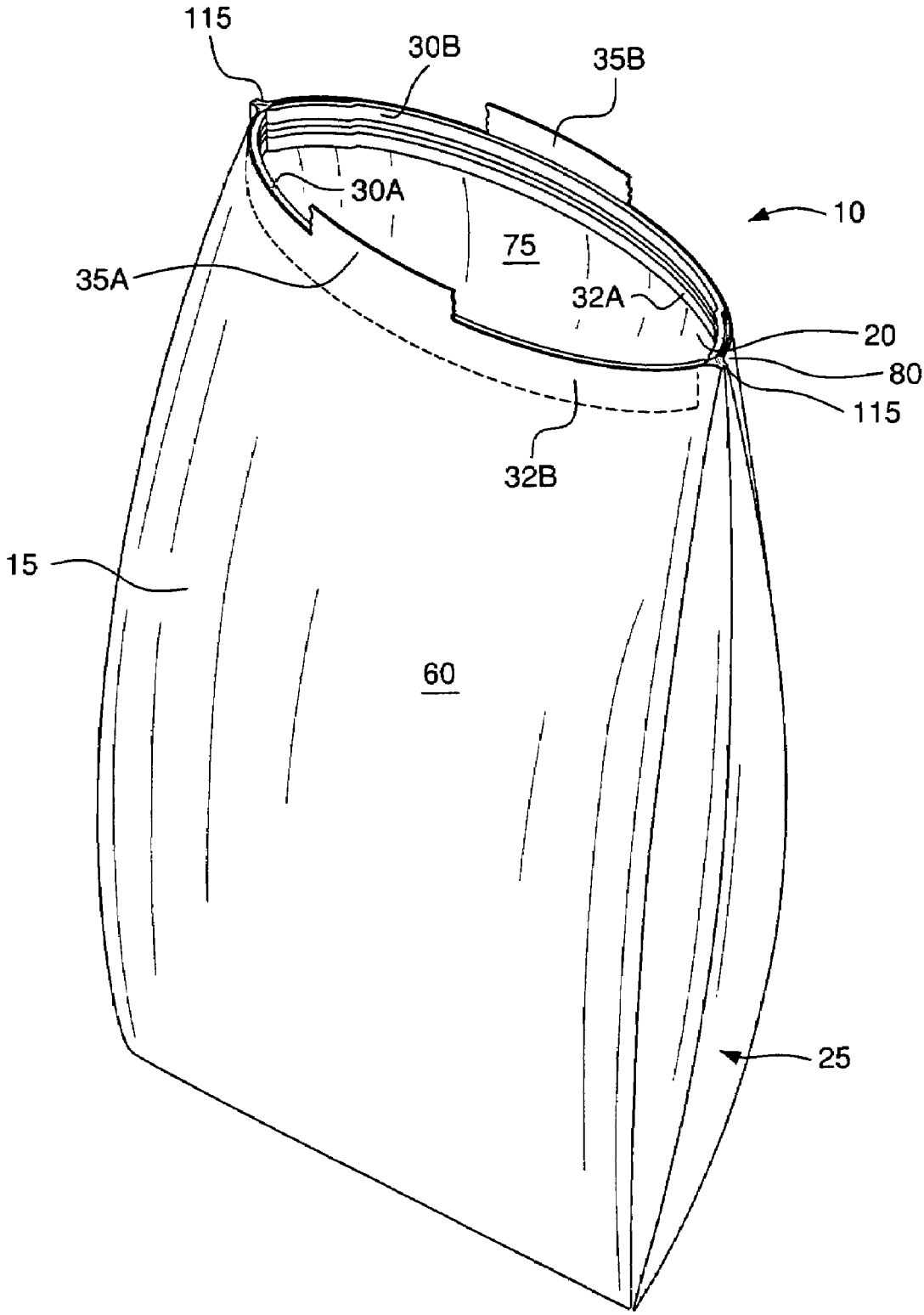
FIG. 1 is a perspective view of a bag constructed according the principles of the invention with parts of the tab portion cut away.

In the drawings, in which like numerals indicate like elements, there is shown a bag constructed according the principles of the present invention. With reference to FIGS. 1, 2, 3A, and 3B a bag 10 includes a first panel 15, a second panel 20, at least one gusset 25, a reclose feature 30 having a flange 32, and easy-open tabs 35. The bag 10 can be a mono-web construction of a film 40.

The film 40 can be plastic, such as low, medium or high density polyethylene, polypropylene, polyester (PET), polyamide or any other material that is commonly used in the packaging industry, copolymers, or blends thereof. The film 40 can be a single layer cast or blown film, a multi-layer coextrusion or laminate. The film 40 can also include one or more layers of paper, metal foil, vacuum deposited metal or inorganic layer of aluminum or silicon oxide and/or a polymer barrier layer, such as ethylene vinyl alcohol or polyvinylidene chloride. It is an important aspect of the invention that the material be capable of allowing a gusset to be formed.

The first panel 15 and the second panel 20 collectively form the mono-web film 40. The mono-web film 40 has a left edge 45 that is also the left edge of the first panel 15 and a right edge 50 that is the right edge of the second panel 20. The first panel 15 includes an inner side 55, an outer side 60, an upper edge 65 and a bottom edge 70. The second panel 20 includes an inner side 75, and outer side 80, an upper edge 85 and a bottom edge 90. If the film 40 is a multi-layer film, it is preferred that at least the inner layer, which forms inner sides 55 and 75, be a heat sealable layer.

The reclose feature 30 includes a first half 30A having a complimentary design to a second half 30B. The two halves 30A, 30B cooperate to allow the bag 10 to be opened and sealed repeatedly. Each half 30A, 30B of the reclose feature 30 can include a flange 32A, 32B. Alternatively, only the second half 30B of the reclose feature 30 includes a flange 32B. One example of the reclose feature 30 is a zipper type feature. As used herein, the expression zipper type feature includes press-to-close and slide-style zippers. Numerous other types of reclose features, such as a Velcro type feature, could be used as well. The reclose feature 30 can be constructed of plastic material; however, other materials can also be used.

Figure 3B:
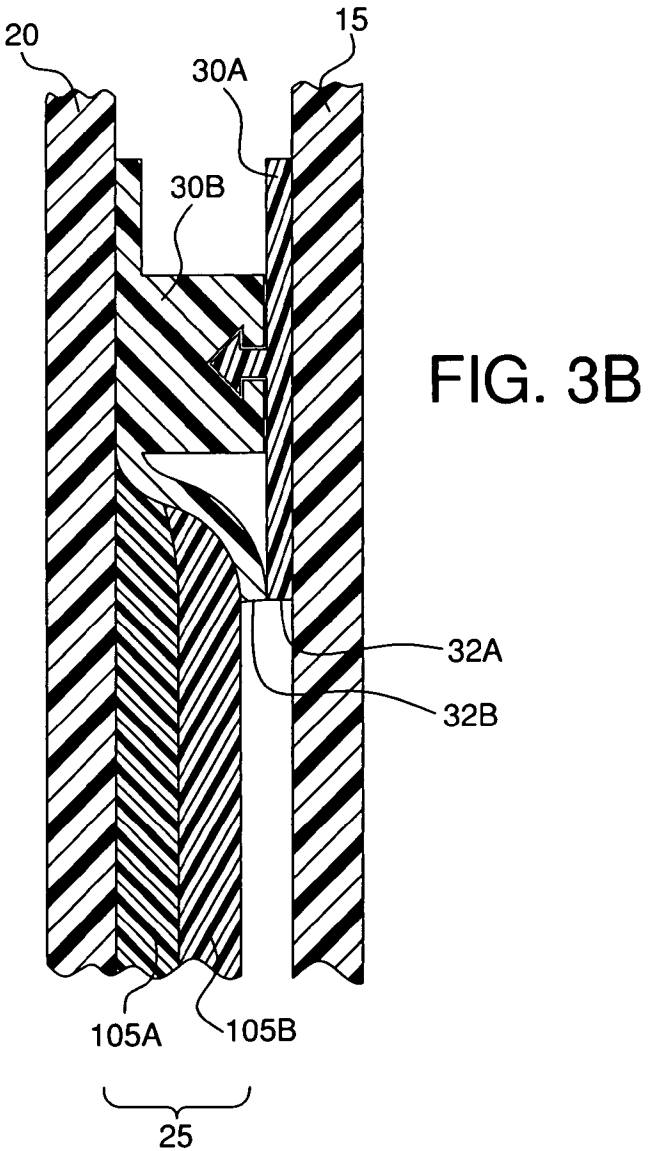
FIG. 3B is a schematic section of the reclose feature and the bag of FIG. 1 proximate the upper edges after a process step of the method of making the bag.
Figure 3A:
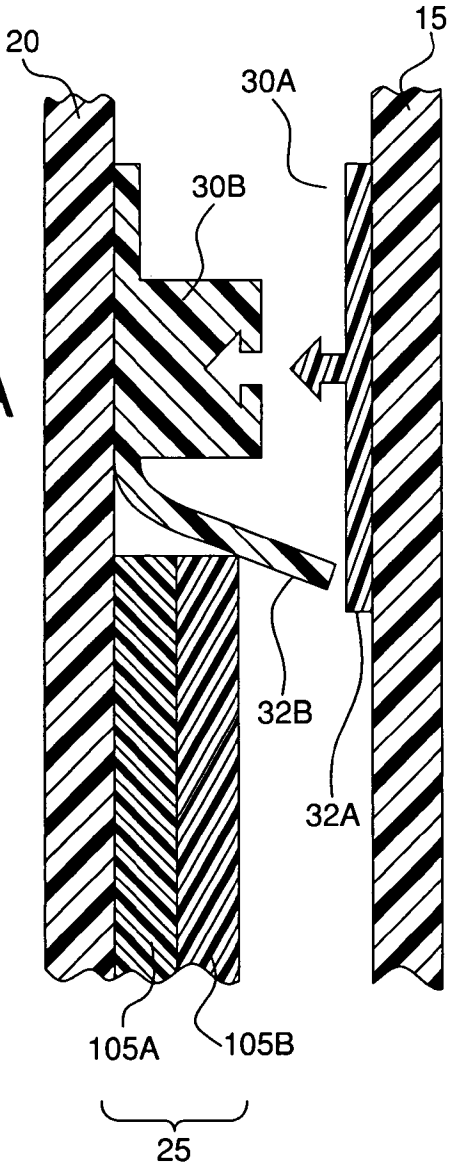
FIG. 3A is a schematic sectional view of the reclose feature and the bag of FIG. 1 proximate the upper edges before a process step of the method of making the bag.

During the production of the bag 10, a continuous strip of the mono-web film 40 travels along the bed of a bag machine. The dimensions of the bag features (e.g., gussets 25 and easy-open tabs 35) are predetermined and controlled by the machine operator or a computer program. According to the desired construction, the reclose feature 30 is applied to a portion of the first panel 15. The halves 30A, 30B of the reclose feature 30 are mated to each other when the reclose feature is applied to the first panel 15. As such, the first half 30A is attached to the first panel 15 and the second half 30B extends substantially orthogonal from the first panel 15. The reclose feature 30 can be attached to the inside surface 55 by heat, ultrasonically, using adhesives or any other method known to those skilled in the art. It is also possible to independently attach the halves 30A, 30B to their respective panels 15, 30. (FIG. 3A is shown according to the latter possibility to help illustrate the relationship between the flange 32B and the top of the gusset.)

At least one portion 95 of the mono-web film 40 is removed from each of the first panel 15 and the second panel 20. If more than one gusset is desired, multiple portions 95A, 95B, 95C are removed from the mono-web 40. As shown, removed portion 95B cooperates with one gusset 25A portion and removed portions 95A, 95C cooperate with a second gusset portion 25B. The removed portions 95 define the upper edges 65 and 85 of the first panel 15 and second panel 20, respectively. The upper edges 65 and 85 can be either of the horizontal edges created by the removed portion 95. The removed portions 95 have a width equal to or slightly greater than the desired size of the gusset 25. Removing a portion of the web 40 greater than the width of the gusset 25 provides segments 100A, 100B of the mono-web 40 that are adjacent to each side of the reclose feature 30. The segments 100A, 100B can be used to provide a seal adjacent to the reclose feature 30, which is described in more detail below.

Figure 2:
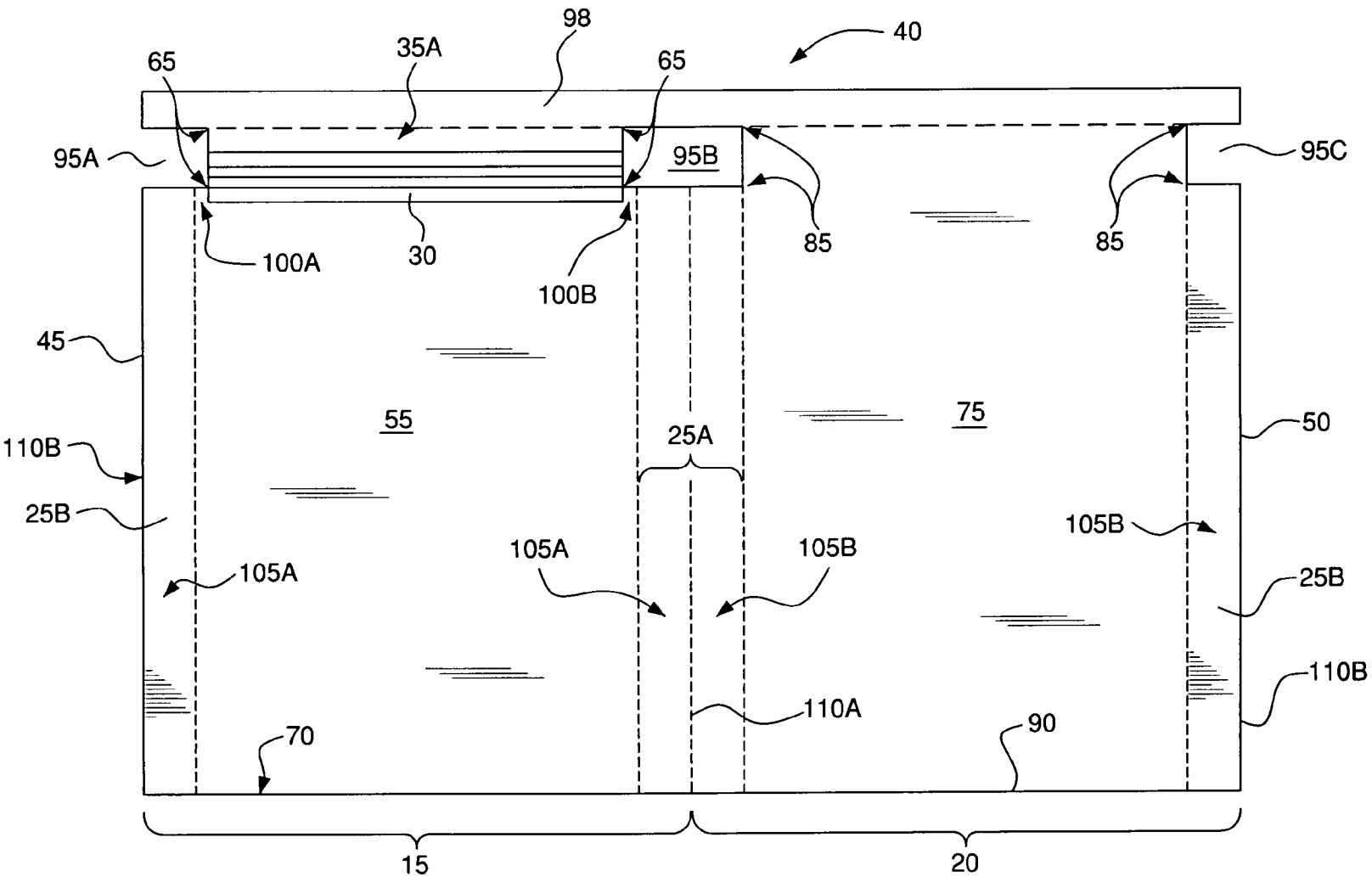
FIG. 2 is a schematic view of a mono-web used to construct the bag of FIG. 1.

In addition to removing the portions 95, a section 98 of the web 40 above the portion 95 and above the reclose feature 30 can be removed by the user when the bag 10 is opened. As shown in FIG. 2, the section 98 is located above the horizontal dashed line. Removing the section 98 creates the easy-open tabs 35. If the tabs 35 run the width of the bag, as shown in FIG. 2, and the film 40 has been transversely oriented, a side notch can be used to allow convenient removal of the section 98. Alternatively, the section 98 can be created by laser scoring, perforation, or other means, to create a line of weakness. In that case, easy-open tabs 35 can be shorter than the width of the bag 10, as shown in FIG. 1.

The right edge 50 of the mono-web 40 is attached to the left edge 45 of the mono-web 40 to create a tube. The left edge 45 and right edge 50 can be sealed to one another by heat sealing, sonic welding, adhesives, or other means. The seal creates an edge joint, lap seal, or fin seal. If a fin seal is to be formed, additional width can be provided at each edge 45, 50. Additional width can be provided at one of the edges if a lap seal is desired. If it is desired for the seal to be formed in the back panel, rather than inside the gusset 25B, the panel 20 can be split and a portion of the panel 20 provided on each side of the panel 15.

Gussets 25A, 25B are added to the bag 10 after the tube is formed. The gussets can be added by plowing a portion of the web 40 into the tube as it travels along the bag machine. Alternatively, the gussets 25 can be added by folding the mono-web 40 prior to forming the tube or after forming the tube. The folds in the mono-web 40 that represent the gussets 25A, 25B are shown by the vertical dashed lines of FIG. 2. The gussets 25 allow the bag 10 to expand as material is added to the bag 10. Each gusset 25 has a pair of faces 105A, 105B (referred to generally as faces 105) that are disposed inside the bag 10. The faces 105 have an inside edge 110 that is disposed between the inner side 55 of the first panel 15 and the inner side 75 of the second panel when the tube is formed. As shown in FIG. 2, the inside edge 110B of gusset 25B can be the seal that is created by joining the left edge 45 with the right edge 50 of the web 40.

Once the gussets 25 are formed, the second half 30B of the reclose feature 30 is attached to the inner side 75 of the second panel 20. The flange 32B of the second half 30B of the reclose feature 30 covers a portion of the inside edge 110 and the faces 105 of the gusset 25, as shown in FIGS. 3A and 3B. In FIG. 3A when the second half 30B of the reclose feature 30 is applied to the inner side 75 of the second panel 20, the flange 32B covers the inside edge 110 and the faces 105 of the gusset 25. The faces 105 cause the flange 32B to protrude from the inner side 75 of the second panel 20. The second half 30B of the reclose feature 30 is secured to the inner side 75 of the second panel 20 by fusion, adhesion, or other similar means. Similarly, the flange 32B and the faces 105 of the gusset 25 are secured to the inner side 75 of the second panel 20. Heat can be used to secure the flange 32B to the faces 105 of the gusset 25. As such, the faces 105, the flange 32B, and the second panel 20 can fuse together in the region that is heated to form one contiguous piece of material. After heating, the flange 32B covers a portion of the faces 105 and a portion of the inside edge 110 of the gusset 25. The mouth of the bag 10 does not open as widely as the body of the bag because a portion the gussets 25 at the mouth of the bag are sealed behind the flange 32B of the second half 30B of the reclose feature 30.

Figure 4A:
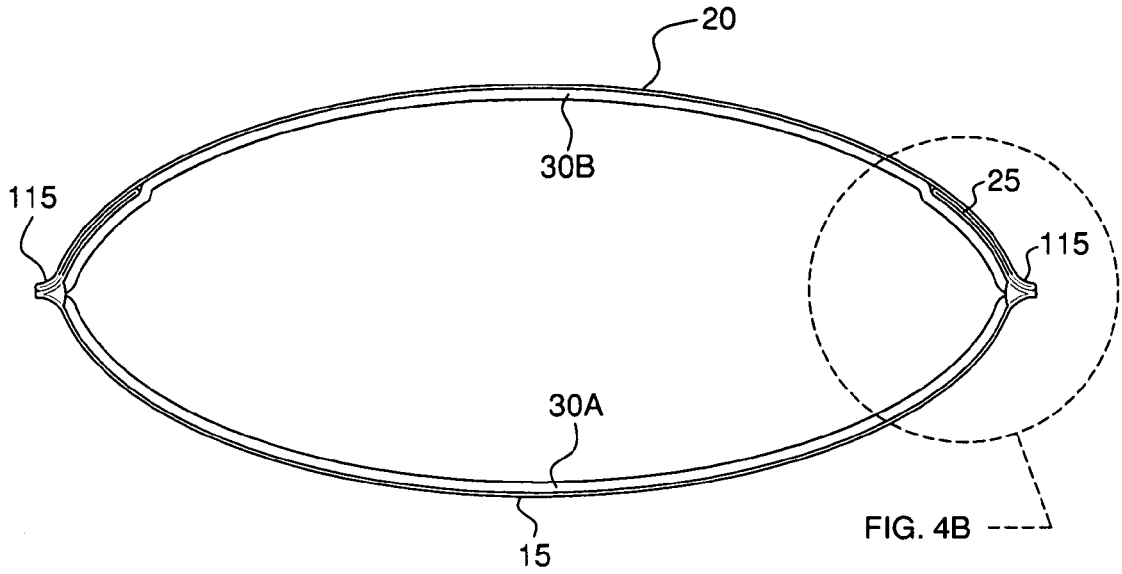
FIG. 4A is a transverse sectional view of the bag of FIG. 1 taken above the reclose feature.
Figure 4B:
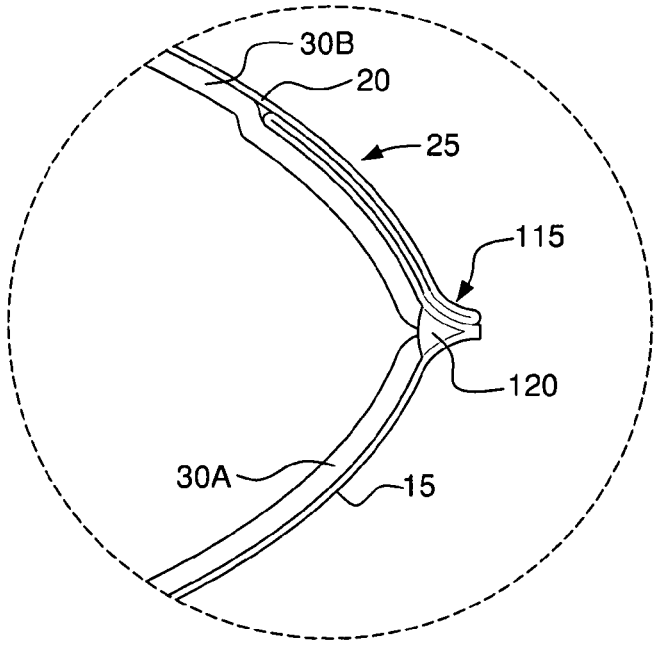
FIG. 4B is an enlarged view of a portion of FIG. 4A.

If the width of the portion 95 is greater than the size of the gusset 25, the segments 100A and 100B of the first panel 15 can be sealed to the respective segments 10A' and 100B' (not shown) of the second panel 20. As shown in FIGS. 4A and 4B, the seal 115 helps create an airtight bag 10. The seal 115 includes the segments 10A, 10A', 100B, 100B' portions of the faces 105 of the gussets 25, portions of the first panel 115 and portions of the second panel 20. To further ensure an airtight seal, portions 120 of the reclose feature 30 can also be incorporated into seal 115. The seal 115 also reinforces the strength of the bag edges to prevent the bag 10 from being damaged during opening.

The bottom of the bag 10 can be formed by heat sealing the bottom edges 70, 90 together. If a stand-up pouch is desired, a second web of material can be used to form the bottom. The bottom of the bag 10 can also include a gusset feature to allow the bottom of the bag to expand in size and increase the total volume of the bag 10.

The bag 10 can be a pre-made type bag or can be constructed on a vertical form/fill/seal (VFSS) machine or a horizontal form/fill/seal (HFSS) machine. In such an embodiment, the material to be placed in the bag 10 is added after forming the tube of the mono-web material.

A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A bag comprising:

a mono-web film folded into a first panel having an inner side and an upper edge, a second panel having an inner side and an upper edge, a recess located between the first and second panels and proximate the upper edges of the first and second panels, and at least one gusset extending downwardly from the recess between the first and second panels and having an inside edge disposed between the inner side of the first panel and the inner side of the second panel and an upper edge that defines the bottom of the recess; and a reclose feature having two halves of complementary shape and a flange, a first half of the reclose feature attached to the upper edge of the inner side of the first panel and a second half of the reclose feature attached to the upper edge of the inner side of the second panel, wherein the flange seals the upper edge of the gusset to the inner side of the second panel.

2. The bag of claim 1 further comprising a tab portion integral to each of the upper edge of the first panel and the upper edge of the second panel.

3. The bag of claim 1 further comprising a seal proximate to the reclose feature.

4. The bag of claim 3 wherein the reclose feature is incorporated into the seal.

5. Bag of claim 1 wherein the reclose feature is a zipper type feature.

6. A bag comprising:

a mono-web film having an upper edge, a bottom edge and two side edges, the film folded to bring the two side edges together and to form a first panel having an inner surface and a second panel having a second panel inner surface, juxtaposed with the inner surface of the first panel, a first recess located between the first and second panels proximate the upper edge, and a second recess located between the first and second panels proximate the upper edge and opposite the first recess;

a first gusset extending downwardly toward the bottom edge from the first recess;

a second gusset extending downwardly toward the bottom edge from the second recess, the first and second gussets having an inside edge disposed between the inner side of the first panel and the inner side of the second panel and an upper edge that defines the bottom of the recess; and a reclose feature having complimentary first and second halves, adapted to engage each other in a closed position, each half having a flange, the flange of the first half of the reclose feature attached to the inner surface of the first panel and the flange of the second half of the reclose feature attached to the second inner surface of the second panel, with the reclose feature extending between the two recesses wherein the flange seals the upper edge of the two gussets to each other and to the inner side of the second panel.

7. The bag of claim 6 further comprising a first tab portion formed between the upper edge of the film on the first panel and the reclose feature.

8. The bag of claim 7 further comprising a second tab portion formed between the upper edge of the film on the second panel and the reclose feature.

9. The bag of claim 6 further comprising seals between first and second panels and first and second gusset portions proximate the ends of the reclose feature adjacent the first and second recesses.

10. The bag of claim 6 wherein the reclose feature is a zipper.

* * * * *

UNITED STATES PATENT AND TRADEMARK OFFICE

CERTIFICATE OF CORRECTION

PATENT NO. : 7,223,017 B2
APPLICATION NO. : 10/741125
DATED : May 29, 2007
INVENTOR(S) : Rodney M. Weaver It is certified that error appears in the above-identified patent and that said Letters Patent is hereby corrected as shown below:

In Column 4
Line 33, change "10A'" to --100A'--
Line 36, change "10A, 10A'" to --100A, 100A'--

Signed and Sealed this

Eighteenth Day of September, 2007

JON W. DUDAS
*Director of the United States Patent and Trademark Office*